US005119700A

United States Patent [19]

Rounds et al.

[11] Patent Number: 5,119,700

[45] Date of Patent: Jun. 9, 1992

[54] AUTOMATIC STUD DRIVING TOOL HAVING COLLARLESS RETENTION MECHANISM FOR DRIVEN HEAD

[75] Inventors: Jerry L. Rounds, Erie; Edward J. Weber, Girard, both of Pa.

[73] Assignee: Titan Tool Company, Fairview, Pa.

[21] Appl. No.: 662,837

[22] Filed: Mar. 1, 1991

[51] Int. Cl.[5] ..... B25B 13/50

[52] U.S. Cl. ..... 81/53.2

[58] Field of Search ..... 81/53.2

[56] References Cited

U.S. PATENT DOCUMENTS

| | | | |
|---|---|---|---|
| 2,516,288 | 7/1950 | Bagoon | 81/53.2 |
| 2,743,639 | 5/1956 | Lynch | 81/53.2 |
| 3,793,912 | 2/1974 | Bilz . | |
| 4,371,354 | 2/1983 | McKean . | |
| 4,470,329 | 9/1984 | McKean . | |
| 4,476,749 | 10/1984 | McKean . | |
| 4,513,643 | 4/1985 | McKean . | |
| 4,590,826 | 5/1986 | McKean . | |
| 4,819,519 | 4/1989 | McKean . | |
| 4,899,626 | 2/1990 | Lymburner . | |
| 4,939,961 | 7/1990 | Lee . | |

*Primary Examiner*—James G. Smith

*Attorney, Agent, or Firm*—Oliff & Berridge

[57] ABSTRACT

An automatic stud driving tool having greater concentricity and reduced run-out includes a cylindrical hollow body; a carriage disposed within the body including jaws for selectively gripping a stud; a driven head rotatable within the body and selectively engageable with the carriage; a snap ring assembly; and an annular retaining groove located on the inside of the hollow body. The driven head, located partially within the hollow body, is retained within the body by inserting the snap ring assembly into the retaining groove.

21 Claims, 4 Drawing Sheets

AUTOMATIC STUD DRIVING TOOL HAVING COLLARLESS RETENTION MECHANISM FOR DRIVEN HEAD

BACKGROUND OF THE INVENTION

This invention relates to automatic stud driving tools used, for example, in the automotive and furniture industries and more particularly to automatic stud driving tools having a collarless retention mechanism for retaining the driven head of the stud driving tool. These stud driving tools are typically able to grasp a stud and thread it into a workpiece, and are then capable of automatically releasing the stud without the requirement that the stud be unthreaded from the tool.

Automatic stud drivers are known in which a stud is rotated to thread or screw the stud into a workpiece. For example, see U.S. Pat. Nos. 4,819,519; 4,590,826; 4,513,643; 4,476,749; 4,470,329; and 4,371,354. The above-referenced patents can be categorized into two groups regarding the structure retaining a driven head within a body. The first group, as typified by U.S. Pat. No. 4,513,643 and shown in FIG. 1 and assigned to the same assignee as the present invention (the disclosure of which is herein incorporated by reference), contains a cylindrical body member 10 provided with a uniform thread on an exterior surface thereof and an interior surface defining a cylindrical cavity for receiving a driven head 30. During assembly, the driven head 30 is positioned in the interior cavity of body 10 and a collar 20 is threadably attached over the driven head on the exterior thread of body 10 to retain driven head 30 within the cavity. Usually a lock ring 200 is threadably attached on the external threads of body 10 and the collar 20 mates with lock ring 200 to lock the collar in place. In order to ensure free rotation of the driven head 30 during loaded conditions, there is preferably about 0.010 inch free end play of the driven head 30. This can be accomplished by fixedly attaching the lock ring 200 in a predetermined location, such as by locktite. This free end play produces run-out, but if the free-play were reduced (by lowering the lock ring 200 and consequently permitting the collar 20 to move longitudinally closer to the body 10), the driven head may be locked-up. This type of assembly, although it allows for easy assembly, requires extra machining on the body as well as a separate collar and lock ring. This type of assembly does not provide an accurate repeat of collar position upon repeated tool assembly and disassembly since the collar may be tightened or loosened to various positions. Further, the assembly collar 20 can shift side to side as much as 0.005", so a looser fit than optimal must be used between the outer diameter of a top portion of the driven head 30 and an aperture on the collar 20 for sliding over the driven head.

The second group can be best described with reference to FIG. 2, which is the assembly of U.S. Pat. No. 4,371,354 assigned to the same assignee as the present invention (the disclosure of which is herein incorporated by reference). This assembly typically comprises a cylindrical base 10 and a cylindrical sleeve 12 rotatable relative to, but longitudinally secured within base 10. The sleeve 12 comprises a cavity which is internally threaded to house a compression spring 32, an adjuster 34 and a socket engaging head 14. The adjuster 34 can be readily rotated within the cavity to adjust the spring force and is fixedly held in place by removable set screws 36. The socket engaging head 14 is externally threaded to cooperate with the internally threaded sleeve 12 and is threadably rotated until mated with an upper surface of cylindrical sleeve 12.

The retention mechanisms for the driven head in these known automatic stud drivers are satisfactory for most stud driving applications. However, the need has arisen for an automatic stud driver having superior concentricity and reduced longitudinal axis play to reduce run-out, allowing use in highly automated applications with minimal supervision while providing quality stud driving precision. Additionally, there is a need for an automatic stud driver which can be more easily manufactured with less parts and which can be easily assembled or disassembled.

OBJECTS OF THE INVENTION

The principle objects of the present invention are to provide an automatic stud driver that can be easily and quickly assembled with a minimum number of tools, which is easier to manufacture than prior automatic stud drivers, which has a greater concentricity, and which will reduce run-out while maintaining free rotation of drive balls on the tool jaws during loading and unloading.

It is another object of the present invention to provide an automatic stud driver which securely and precisely locates a driven head within the carriage without a collar.

An automatic stud driving tool having greater concentricity and reduced run-out in accordance with the present invention includes a cylindrical hollow body; a carriage disposed within the body including jaws for selectively gripping a stud; a driven head rotatable within the body and selectively engageable with the carriage; a snap ring assembly; and an annular retaining groove located on the inside of the hollow body. The driven head, located partially within the hollow body, is retained within the body by inserting the snap ring assembly into the retaining groove.

BRIEF DESCRIPTION OF THE DRAWINGS

The invention will be described with reference to the following detailed description taken in conjunction with the attached drawings in which.

DETAILED DESCRIPTION OF THE PREFERRED EMBODIMENTS

Figure 1:
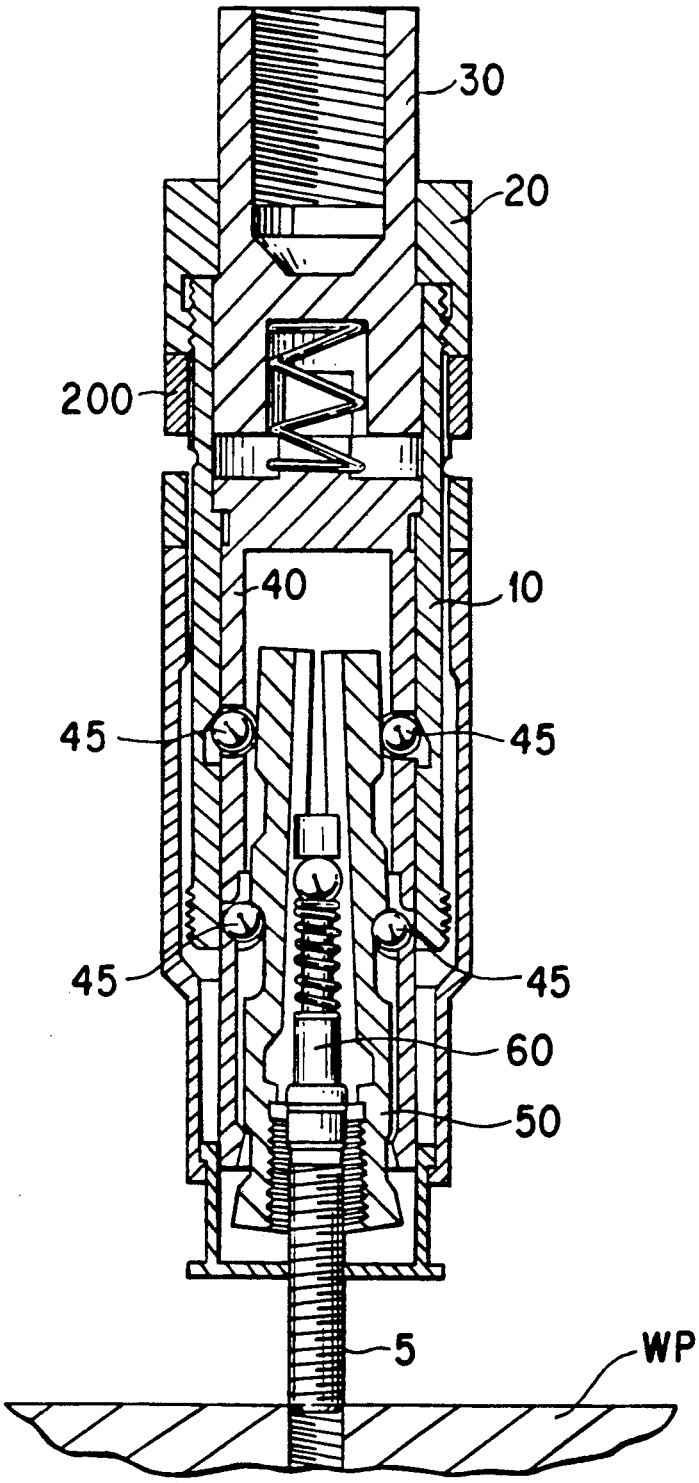
FIG. 1 (PRIOR ART)
FIG. 1 is a cross-sectional view of a prior art stud driver having a separate assembly collar and lock ring.
Figure 2:
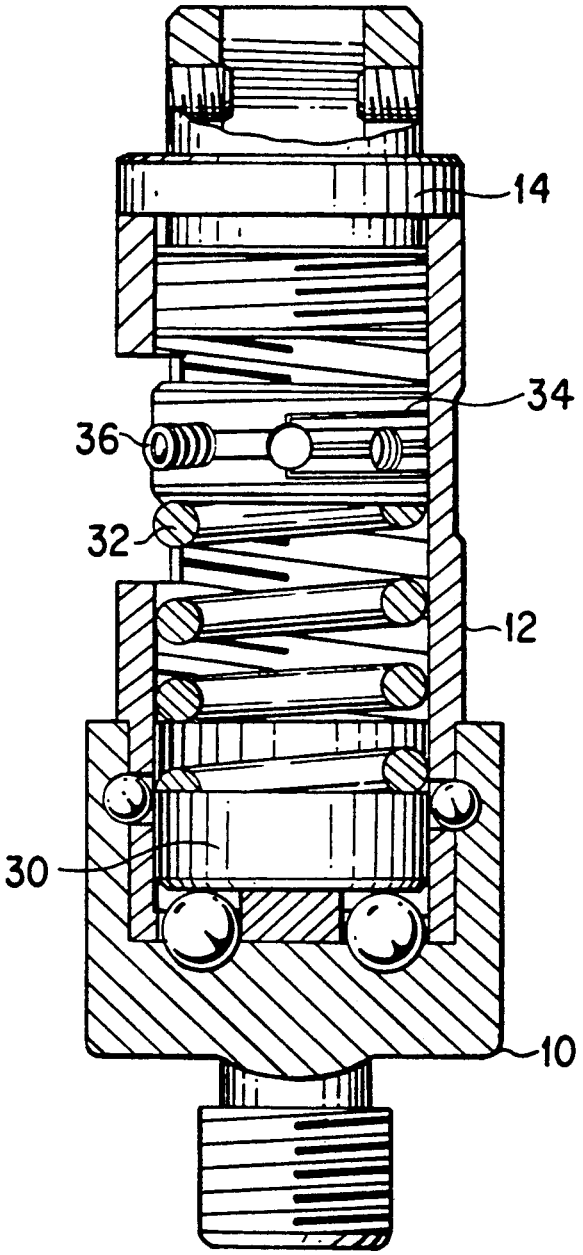
FIG. 2 PRIOR ART
FIG. 2 is a cross-sectional view of a prior art stud driver having a threaded driven head member and an adjustable spring assembly.

The automatic stud driver according to the present invention is preferably composed of a body 10; a driven head 30; a driven head retaining assembly 140; a carriage 40; two sets of balls 45 in the carriage; a set of jaws 50; and a plunger 60.

The operation of a typical stud driver for use with the present invention can be summarized with reference to FIG. 1 which illustrates an exemplary stud driver of the type disclosed in U.S. Pat. No. 4,513,643, the disclosure of which is herein incorporated by reference. The stud driver includes a cylindrical body 10 having an internal cylindrical body cavity 12, and a driven head 30 disposed within the cavity 12 of the body 10. A cylindrical carriage 40 rotates within the body cavity 12 and is capable of limited axial movement therein between an upper position where it is engaged for rotation with the driven head 30, and a lower position. An assembly of jaws 50 reciprocates within the carriage 40 on drive balls 45, each jaw preferably being semi-cylindrical with a thread corresponding to that of a stud 5 to be driven into workpiece WP. While two jaws 50 of 180° each are illustrated, the invention is applicable to a stud driver with two or more jaws. Each jaw 50 includes a semi-cylindrical groove 51 extending for the axial length of each jaw. The lower section of the groove 51 includes a threaded section 54. A plunger mechanism 60 is located between the jaws 50 for moving the jaws 50 between an open lower position and a closed upper position, the plunger mechanism being spring-biased to urge the jaws toward the open lower position.

In the initial position illustrated in FIG. 1, the jaws 50 are open and the stud 5 is inserted until the head of the stud contacts the plunger mechanism 60. Further movement of the stud 5 against the plunger mechanism 60 moves the plunger mechanism 60 upward to retract jaws 50 within the carriage 40, and the carriage 40 within the body 10, thus requiring the jaws 50 to pivot to the closed position in which the threaded portions of the jaw 50 are clamped about the stud 5. Continued retraction of the carriage 40 within the body 10 eventually engages the carriage 40 with the driven head 30 to rotate the carriage 40 and the jaws 50, which in turn rotate the stud 5 into the workpiece WP and advances the body 10 toward the workpiece WP. When the body 10 is prevented from further advancement, threading of the stud 5 into the workpiece WP draws the carriage 40 downward to the lower position. When the stud driver is pulled away from the workpiece WP, the jaws 50 are pulled downward from the carriage 40, thus allowing the jaws to pivot to the open position and release the stud 5. The operation is repeated for the next stud. While the invention is applicable to the stud driver in U.S. Pat. No. 4,513,643, it is also applicable to any tool and other stud drivers including those disclosed in U.S. Pat. Nos. 4,819,519; 4,590,826; 4,476,749; 4,470,329; 4,371,354; and 3,793,912, the disclosures of which are also herein incorporated by reference.

In order to improve the concentricity of the stud driving tool, the driven head 30 must be precisely located and fixedly retained in a predetermined location with minimal longitudinal play and side to side play. The driven head 30, however, must additionally be allowed to rotate freely or it will cause drive balls on the jaws 50 to load and unload in the same location, accelerating tool wear.

Figure 5:
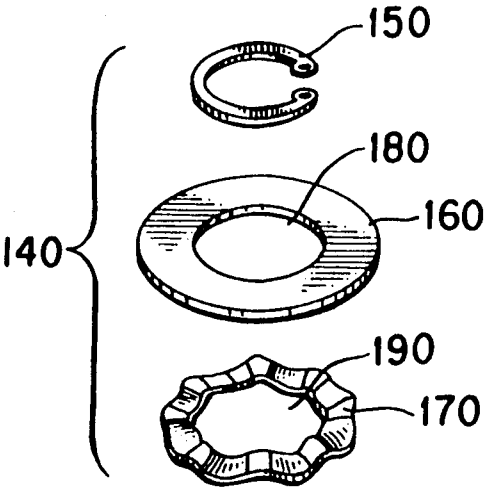
FIG. 5 is an exploded perspective view of a preferred retaining assembly of the present invention.
Figure 3:
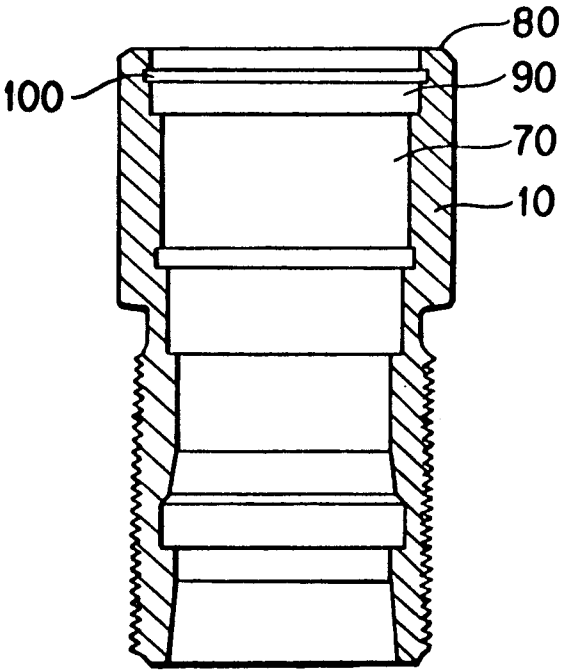
FIG. 3 is a cross-sectional view of a cylindrical hollow body member of the present invention.

To retain the driven head 30 while accommodating these competing interests, the present invention utilizes an integral hollow cylindrical body 10, as shown in FIG. 3, having a main hollow cavity 70 of a predetermined substantially concentric size, preferably with tolerances of +/−0.0005" or better. Near a top face 80 of the body 10 is a slightly larger hollow cavity 90 which will house a portion of a retaining assembly 140 (FIG. 5). Above this slightly larger cavity 90 is a retaining groove 100 cut into the inside perimeter of the cavity 90 to house a portion of the retaining assembly as discussed below.

Figure 4:
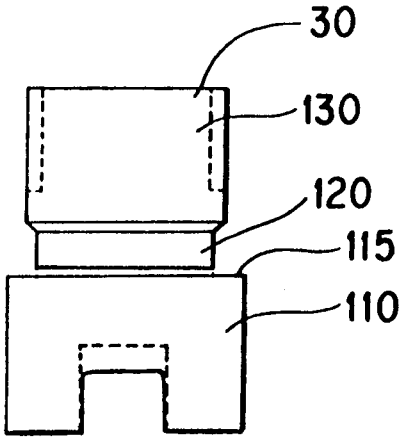
FIG. 4 is a side view of a driven head member of the present invention.

Driven head 30, as shown in FIG. 4, is manufactured to high tolerances and concentricity, preferably +/−0.0005", and includes a first portion 110 which engages the carriage 40 and maintains minor clearance within the first main hollow cavity 70. The first portion preferably has tolerances of ±0.0005 inches. A second portion 120 is of reduced diameter and of a size and length to maintain a clearance within an aperture in the retaining assembly. Located immediately above the second portion is a top third portion 130 which is sized and shaped to mate with a rotational input or driving means, not shown.

Figure 6:
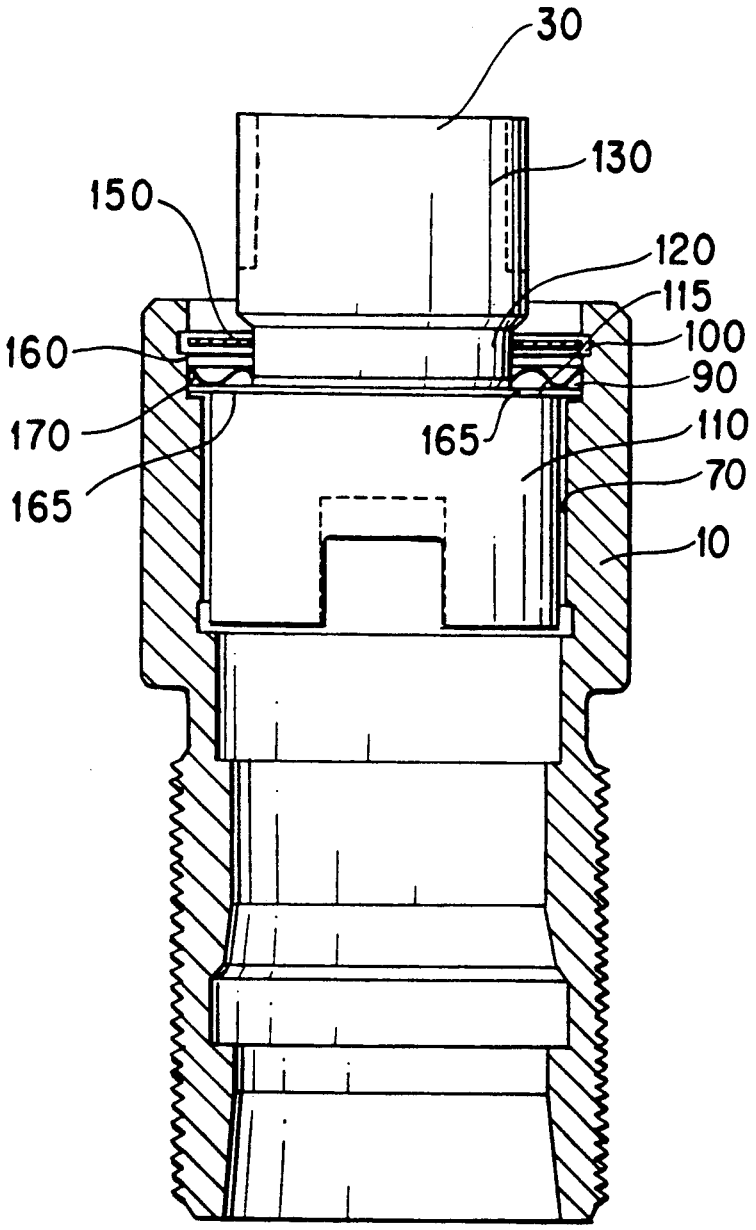
FIG. 6 is a cross-sectional view of the assembled components of FIGS. 3-5.

The retaining assembly 140, as shown in FIG. 5, preferably comprises a snap ring 150, a retaining washer 160, and a wave washer 170. Additional elements or fewer elements may be utilized depending on the specific application and alternate elements may replace the snap ring 150 as long as they fit within the retaining groove 100 and sufficiently retain the driven head 30 within the body 10. For example, an additional lower retaining washer 165 (having the same structure as the upper retaining washer 160) may be provided to sandwich the wave washer 170 between the upper washer 160 and lower washer 165 (as illustrated in FIG. 6) to protect the wave washer 170 against wear from contact with the top face 115 of the driven head 30. The snap ring 150 is elastic and sized to be fixedly retained within the retaining groove 100 upon insertion of the snap ring 150 into the groove 100. When inserted, the snap ring 150 has an inner diameter smaller than the diameter of the first portion 110. The upper retaining washer 160 is located against the snap ring 150 and contained within the slightly larger hollow cavity 90. The washer 160 has an aperture 180 therethrough of a size sufficient to fit over the top portion 130 of the driven head 30 with minor clearance, but not over the first portion 110. The wave washer 170 is additionally housed within the slightly larger hollow cavity 90 and snugly fits between the retaining washer 160 and a top face 115 of the first portion 110 of the driven head 30, or between the two retaining washer 160, 165. The wave washer has an aperture 190 therethrough sufficient to fit over the top portion 130 of the driven head 30, but not over the first portion 110. The wave washer 170, when located between the washer 160 and the top face 115, or between the two retaining washers 160, 165, provides a compressive force which reduces end play of the driven head 30. The washers 160, 165 and wave washer 170 have diameters greater than the inner diameter of the hollow cavity 70 so they cannot enter the hollow cavity 70.

The stud driver of the present invention is assembled as follows: The internal components including the carriage 40, jaws 50 and other elements are assembled as in U.S. Pat. No. 4,513,643, for example. Next, as shown in FIG. 6, the first portion 110 of the driven head 30 is inserted into the hollow cavity 70 of the body 10 and rotated until it mates with carriage 40. The lower retaining washer 165, if used, is placed over the top portion 130 of the driven head until it contacts the top face 115 of the driven head 30. Wave washer 170 is placed over the top portion 130 of the driven head 30 until it contacts either the lower retaining washer 165 (if used), or the top face 115 of the first portion 110 of the driven head 30 (if the lower washer 165 is not used), followed by placing the retaining washer 160 over the top portion 130 of the driven head 30 until it contacts the wave washer 170. The snap ring 150 is then placed over the top portion 130 of driven head 30 and inserted into the retaining groove 100 on the body 10 by a pair of snap ring pliers. The pliers initially compress the snap ring for placement within the body 10 (the second portion 120 of the driven head 30 providing additional clearance between the driven head 30 and body 10 for insertion of the snap ring into the body) and relaxation of the pliers permits the snap ring to elastically expand into the groove 100. The snap ring 150 contains washer 160 and wave washer 170 in the body adjacent the driven head.

The finished assembly provides a stud driver having greatly improved concentricity and reduced run-out. The driven head 30 is freely rotatable in the hollow cavity and has reduced longitudinal play and side to side play relative to prior art stud driving tools. Disassembly can be accomplished by reversing the procedure.

The invention has been described with reference to its preferred embodiments which are intended to be illustrative and not limiting. Various changes may be made without departing from the spirits and scope of the invention as defined in the following claims.

What is claimed is:

1. An automatic stud driving tool comprising:

a cylindrical hollow body having a longitudinal axis and an inner surface defining an inner diameter;

a cylindrical carriage disposed within said hollow body and longitudinally axially movable relative to said body between two axial positions, said carriage having a cavity therein;

a plurality of stud gripping jaw means disposed at least partially within said cavity and being axially movable relative to said carriage for assuming a stud gripping position and a stud releasing position;

a driven head rotatable within the inner surface of said body for transmitting rotational input to said carriage, said driven head defining an outer diameter smaller than said inner diameter of said hollow body at the inner surface and being engaged with said carriage when said carriage assumes one of said first and second positions and disengaged from said carriage in said other of said first and second positions; and retention means mounted on the inner surface within the hollow body and interposed between said inner surface of said body and said driven head for retaining said driven head within said body.

2. The automatic stud driving tool of claim 1, wherein said retention means comprises a retaining groove on said inner surface of said body and a snap ring selectively insertable into said retaining groove for retaining said driven head within said body.

3. The automatic stud driving tool of claim 2, wherein said retaining means further includes a retaining washer disposed between said snap ring and said driven head.

4. The automatic stud driving tool of claim 2, wherein said retaining means further includes a wave washer disposed between said snap ring and said driven head.

5. The automatic stud driving tool as in claim 4, wherein said retaining means further includes a pair of retaining washers, one on each side of said wave washer.

6. The automatic stud driving tool of claim 3, wherein said retaining means further includes a wave washer disposed between said retaining washer and said driven head.

7. The automatic stud driving tool of claim 2. wherein said driven head includes a first diameter portion for engaging said carriage and a second relatively smaller diameter portion for engaging said rotational input, said snap ring having an inner diameter less than the diameter of said first diameter portion to retain said driven head within said body.

8. The automatic stud driving tool of claim wherein:

said driven head includes a first diameter portion for engaging said carriage and a second relatively smaller diameter portion for engaging said rotational input;

said inner surface of said body includes a first cavity having a diameter sufficient to accommodate said first diameter portion of said driven head and a second cavity having a diameter larger than the diameter of said first cavity; and said retention means comprises a retaining groove in said second cavity and having a diameter larger than the diameter of said second cavity and a snap ring selectively insertable into said retaining groove, said snap ring having an inner diameter less than the diameter of said first diameter portion of said driven head for retaining said driven head in said body.

9. The automatic stud driving tool of claim 8, wherein said retaining means further includes a wave washer disposed between said snap ring and said first diameter portion of said driven head.

10. The automatic stud driving tool of claim 9, wherein said retaining means further includes a pair of retaining washers disposed on opposite sides of said wave washer.

11. The automatic stud driving tool of claim 1, wherein said retention means includes wave washer bias means for urging said driven head toward said carriage to reduce end play.

12. An automatic stud driving tool comprising:

a cylindrical hollow body having a longitudinal axis and an inner surface;

a cylindrical carriage disposed within said hollow body and longitudinally axially movable relative to said body between two axial positions, said carriage having a cavity therein;

a plurality of stud gripping jaw means disposed at least partially within said cavity and being axially movable relative to said carriage for assuming a stud gripping position and a stud releasing position;

a driven head rotatable within said body for transmitting rotational input to said carriage, said driven head being engaged with said carriage when said carriage assumes one of said first and second positions and disengaged from said carriage in said other of said first and second positions; and retention means interposed between said inner surface of said body and said driven head for retaining said driven head within said body, wherein said retention means comprises a retaining groove on said inner surface of said body and a snap ring selectively insertable into said retaining groove for retaining said driven head within said body.

13. An automatic stud driving tool comprising:

a cylindrical hollow body having a longitudinal axis and an inner surface;

a cylindrical carriage disposed within said hollow body and longitudinally axially movable relative to said body between two axial positions, said carriage having a cavity therein;

a plurality of stud gripping jaw means disposed at least partially within said cavity and being axially movable relative to said carriage for assuming a stud gripping position and a stud releasing position;

a driven head rotatable within said body for transmitting rotational input to said carriage, said driven head being engaged with said carriage when said carriage assumes one of said first and second positions and disengaged from said carriage in said other of said first and second positions; and retention means interposed between said inner surface of said body and said driven head for retaining said driven head within said body, wherein:

said driven head includes a first diameter portion for engaging said carriage and a second relatively smaller diameter portion for engaging said rotational input;

said inner surface of said body includes a first cavity having a diameter sufficient to accommodate said first diameter portion of said driven head and a second cavity having a diameter larger than the diameter of said first cavity; and said retention means comprises a retaining groove in said second cavity having a diameter larger than the diameter of said second cavity and a snap ring selectively insertable into said retaining groove, said snap ring having an inner diameter less than the diameter of said first diameter portion of said driven head for retaining said driven head in said body.

14. An automatic stud driving tool comprising:

a cylindrical hollow body having a longitudinal axis and an inner surface;

a cylindrical carriage disposed within said hollow body and longitudinally axially movable relative to said body between two axial positions, said carriage having a cavity therein;

a plurality of stud gripping jaw means disposed at least partially within said cavity and being axially movable relative to said carriage for assuming a stud gripping position and a stud releasing position;

a driven head rotatable within said body for transmitting rotational input to said carriage, said driven head being engaged with said carriage when said carriage assumes one of said first and second positions and disengaged from said carriage in said other of said first and second positions; and retention means interposed between said inner surface of said body and said driven head for retaining said driven head within said body, said retention means including means for urging said driven head toward said carriage to reduce end play.

15. The automatic stud driving tool of claim 14, wherein the retention means is mounted on the inner surface within the hollow body.

16. The automatic stud driving tool of claim 15, wherein the inner surface of the hollow body defines an inner diameter; and the driven head defines an outer diameter smaller than the inner diameter of the hollow body at the inner surface.

17. The automatic stud driving tool of claim 14, wherein said retention means comprises a retaining groove on said inner surface of said body and a snap ring selectively insertable into said retaining groove for retaining said driven head within said body.

18. The automatic stud driving tool of claim 17, wherein said retaining means further includes a retaining washer disposed between said snap ring and said driven head.

19. The automatic stud driving tool of claim 17, wherein said urging means includes a wave washer disposed between said snap ring and said driven head.

20. The automatic stud driving tool as in claim 19, wherein said retaining means further includes a pair of retaining washers, one on each side of said wave washer.

21. The automatic stud driving tool as in claim 14, wherein the means for urging includes a wave washer.

* * * * *